United States Patent [19]

Kuhfuss

[11] Patent Number: 4,677,910

[45] Date of Patent: Jul. 7, 1987

[54] PROCESS FOR PROCESSING SECURITY PAPER WEBS OR SECURITY PAPER SHEETS TO FORM BUNDLES OF SECURITY PAPERS

[75] Inventor: Runwalt Kuhfuss, Metzingen, Fed. Rep. of Germany

[73] Assignee: De La Rue Giori S.A., Lausanne, Switzerland

[21] Appl. No.: 746,555

[22] Filed: Jun. 19, 1985

[30] Foreign Application Priority Data

Jul. 5, 1984 [CH] Switzerland ..... 3251/84

[51] Int. Cl.[4] ..... B41J 1/00; B07C 5/00

[52] U.S. Cl. ..... 101/93.01; 70/58; 209/3.3; 209/9; 209/569; 101/93.07; 101/426

[58] Field of Search ..... 101/76, 77, 79, 91, 101/92, 426, 232, 228; 377/15, 28, 30; 209/3.3, 4, 9, 534, 551, 552, 588, 569; 371/15, 16, 18, 25; 83/88; 270/58

[56] References Cited

U.S. PATENT DOCUMENTS

| | | | |
|---|---|---|---|
| 1,038,348 | 9/1912 | Gompf | 101/77 |
| 1,480,395 | 1/1924 | Johnston | 101/76 |
| 2,343,880 | 3/1944 | Brownlee | 101/76 X |
| 3,023,900 | 3/1962 | Thier | 209/3.3 |
| 3,237,556 | 3/1966 | Huffman | 101/77 |
| 4,255,651 | 3/1981 | Phillips | 377/30 X |

FOREIGN PATENT DOCUMENTS

| | | | |
|---|---|---|---|
| 129759 | 12/1976 | German Democratic Rep. | 101/76 |

*Primary Examiner*—Randolph A. Reese
*Assistant Examiner*—Glenn B. Foster
*Attorney, Agent, or Firm*—Kane, Dalsimer, Kane, Sullivan and Kurucz

[57] ABSTRACT

Processing is based on print carriers in the form of security paper webs or security paper sheets, containing security paper prints which are arranged in the manner of matrices in transverse rows and longitudinal rows and on which spoilt notes are identified by a mark which can be read by a reading instrument. The print carriers pass, in succession, by a reading instrument which detects the positions of the spoilt notes and feeds them into a computer for storage, a cancellation printer controlled by this computer, which provides spoilt notes with a cancellation print, and a numbering machine. The numbering mechanisms of this numbering machine are moved forward by the computer in such a way that always the satisfactory security paper prints, placed in succession in any longitudinal row, are serially numbered, the spoilt notes being neglected. Subsequently, the print carries, having passed by another reading instrument, are cut up into individual security papers, the spoilt notes are separated out in a separation device and the remaining, serially numbered individual security papers are assembled to form bundles, each having a complete numerical sequence. In this way, correct and complete numerical sequence of the security papers contained in the automatically produced security paper bundles and security paper parcels is ensured, in spite of the separation of spoilt notes.

9 Claims, 8 Drawing Figures

| | L1 | L2 | L3 | L4 | |
|---|---|---|---|---|---|
| I | A 1 | B 1 | C 1 | D 1 | M |
| II | A 2 | B 2 | C 2 | ~~D 2~~ | Mx |
| III | A 3 | B 3 | ~~C 3~~ | D 2 | |
| IV | ~~A 4~~ | B 4 | C 3 | D 3 | K |
| Mx V | A 4 | ~~B 5~~ | C 4 | D 4 | |
| VI | A 5 | B 5 | C 5 | ~~D 5~~ | |
| VII | A 6 | ~~B 6~~ | C 6 | D 5 | |
| VIII | A 7 | B 6 | C 7 | D 6 | |
| I | A 8 | B 7 | C 8 | D 7 | |
| II | A 9 | B 8 | ~~C 9~~ | D 8 | |
| III | A 10 | B 9 | C 9 | ~~D 9~~ | |
| IV | A 11 | B 10 | C 10 | D 9 | |
| V | A 12 | B 11 | ~~C 11~~ | D 10 | |
| VI | A 13 | B 12 | C 11 | ~~D 11~~ | |
| Mx VII | ~~A 14~~ | B 13 | ~~C 12~~ | D 11 | |
| VIII | A 14 | B 14 | C 12 | ~~D 12~~ | |

| | | | |
|---|---|---|---|
| A 99423 | B 99999 | C 99225 | D 99729 |
| A 99424 | | C 99226 | D 99730 |
| A 99425 | B 100000 | C 99227 | D 99731 |

Fig. 2

PROCESS FOR PROCESSING SECURITY PAPER WEBS OR SECURITY PAPER SHEETS TO FORM BUNDLES OF SECURITY PAPERS

BACKGROUND OF THE INVENTION

1. Field of Invention

The invention relates to a process for processing print carriers, printed with security paper prints, in the form of security paper webs or security paper sheets, the security paper prints of which are arranged in the manner of matrices in transverse rows and longitudinal row, to form bundles of security papers from numbered individual security papers, following which the print carriers, after the spoilt notes detected on them have been marked, pass through a numbering machine and, after the print carriers have been cut up, the spoilt notes are separated out.

2. The Prior Art

One of the main problems in the production of security papers, particularly in the manufacture of banknotes, is to obtain bundles of security papers or parcels of security papers in which the security papers have a complete numerical sequence, that is to say, they are serially numbered correctly within a certain numerical series. This kind of complete numerical sequence is very important both for organising manufacture and as a protection against forgeries.

In the essentially fully automatic manufacture and processing of security papers as developed and introduced in recent years, however, difficulties arise in obtaining bundles of security papers with a complete numerical sequence, owing to the spoilt notes which appears virtually invariably and have to be separated out. These difficulties are connected with the hitherto customarty numbering and processing methods.

A known process for processing security paper sheets is described, for example, in West German Pat. No. 2,502,987 and in U.S. Pats. Nos. 3,939,621 and 4,045,944. There, the freshly printed security paper sheets, containing unnumbered security paper prints, arranged in the manner of matrices in rowss and columns, are visually checked, security paper prints, identified as spoilt notes, being provided, for ultimate separation, with a mark to which a detector responds. All the security paper sheets then pass through a numbering machine in which all security paper prints, that is to say also the spoilt notes, are numbered on each sheet.

In the hitherto customary numbering, all those security paper prints are always provided with a serial number sequence which are situated in the same security paper positions of successive sheets, that is to say, always in the same row and in the same column. In the stack of sheets formed at the exit of the numbering machine which generally contains 100 sheets, therefore, all the superimposed security paper prints which represent a bundle of security papers when the stack of sheets has been cut up afterwards, always have a serial number sequence. In this case, all the security paper positions of a sheet may have identical numbering and differ by different serial indications.

Subsequently, the numbered sheet stacks are cut up to form bundles of individual security papers and only then those security paper bundles are separated out from the transport sequence of the individual bundles which contain one or more spoilt notes. These separated security paper bundles are submitted to a parallel processing operation in which the spoilt note or notes are eliminated and replaced by satisfactory security papers; these replacement security papers are either numbered with the number of a special series or they are provided in a manual numbering device with the number of the extracted spoilt note, so that complete numerical sequence is ensured within that bundle. The complete bundle thus reconstituted is replaced in the appropriate position of the transport sequence of the bundle that had been satisfactory from the start, before the bundle parcels are made up.

For making up the bundle parcels in which all security papers have a correct serial number sequence within the same numerical series, the security paper bundles formed in succession when the sheet stacks have been cut have to be sorted in such a way that the bundles from successivee sheet stacks, belonging to the same numerical series, are assembled together. This type of automatic sorting and bundle stacking device is described in the above-mentioned patent specifications.

The processing method explained above, which enables complete numerical sequences to be produced within the security paper bundles and security paper parcels formed, despite the separation of spoilt notes, has not gained acceptance in practice, however, because the special treatment of the security paper bundles, containing spoilt notes, is labour-intensive and time-consuming and the normal working rate at which satisfactory bundles of security papers, free from spoilt notes, were able to be processed had frequently to be lowered.

Another known process that has been practised, according to which complete numerical sequences are ensures within the security paper bundles formed in the processing of security paper sheets consists in separating out, after the visual check on the freshly printed security paper sheets and already before the numbering operation, all those sheets on which at least one spoilt note had been detected and marked. In this case, therefore, only sheets with satisfactory security paper prints are introduced into the numbering machine and the resulting numbered sheet stacks are processed further, as described above. The disadvantage in this case is the fact that the security paper sheets, containing spoilt notes, have to be submitted to special processing, unless they are to be destroyed, uneconomically, in toto. This special processing consists in first cutting up the unumbered sheets into individual security papers of final size, then separating out the marked spoilt notes and giving the remaining, satisfactory, security papers a serial numbering in a numbering machine for individual security papers, these numbers belonging to a special series.

For security papers produced by web printing, there is as yet no resonable and practicable method of maintaining the complete numerical sequence, if spoilt notes have to be separated out when the web have been cut up into individual securuty papers, as is virtually always the case. Therefore, all the security papers, including the spoilt notes, have been numbered in web printing so far and only the numbers of the then separated spoilt notes have been recorded, so as to have a check, but a complete numerical sequence of the satisfactory security papers to be issued was not obtainable.

SUMMARY OF THE INVENTION

The invention is based on the object of providing a processing method both for security paper webs and for security paper sheets, by means of which a sequence of satisfactory security papers is unbroken, complete numerical sequence is obtained even when the processed security paper web or the processed security paper sheets contain spoilt notes in uneven distribution, which have to be separated out as reject security papers.

This object is achieved according to the invention by the features indicated in claim 1.

Suitable embodiments of the process according to the invention and of the apparatus, according to the invention, for carrying out this process become clear from the subsidiary claims.

The process can be carried out by means of conventional numbering machines, which have merely to be equipped with special numbering mechanisms, and by means of devices and components which are also known in the automatic processing of security papers and it avoids in a simple manner all the existing problems connected with the production of a complete numerical sequence; at the same time, the processing safety is increased, since no security paper sheets or security paper bundles have to be withdrawn from the normal, virtually fully automatic processing after the visual inspection and to be submitted to a parallel processing operation and because each spoilt note can still be provided with a clear cancellation print within the automatic processing unit.

Above all, it becomes possible, for the first time, to obtain a complete numerical sequence of the finished satisfactory security papers in web printing, even if, as is virtually always the case, the security paper web contains unevenly distributed spoilt notes.

The invention will be explained in detail by exemplary embodiments with reference to the drawings.

THE DRAWINGS

FIG. 1*a* shows, in diagrammatic representation, an apparatus for carrying out the process according to the invention in the case of a security paper web;

FIG. 1*b* shows a plan view on to this apparatus;

FIG. 2 shows diagrammatically a numbered security paper web, comprising four longitudinal rows, each rectangle representing a security paper print with the serial number indicated;

Figure 6:
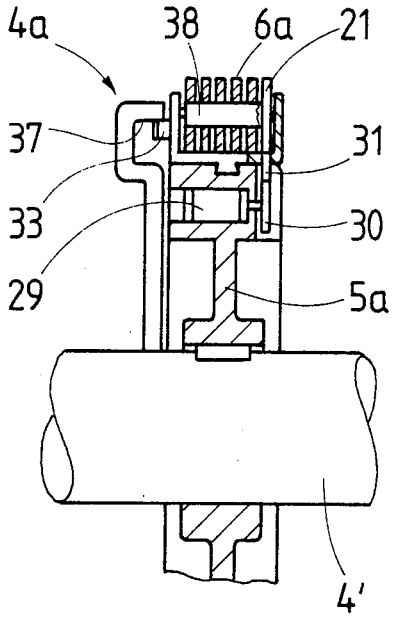
FIG. 6 shows a diagrammatic view of one of the numbering mechanism of the numbering machine, mounted on a numbering cylinder.
Figure 6A:
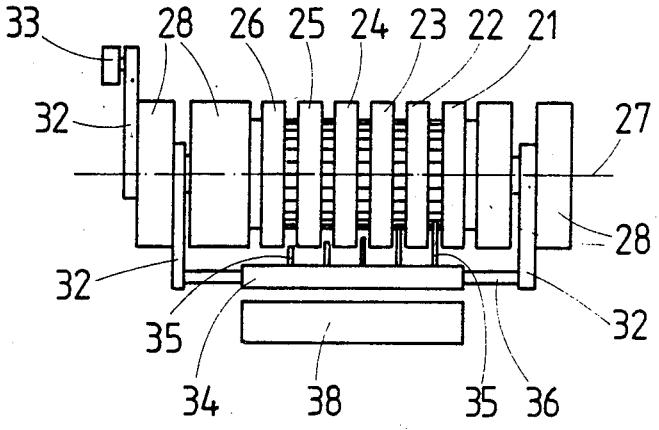
Figure 6B:
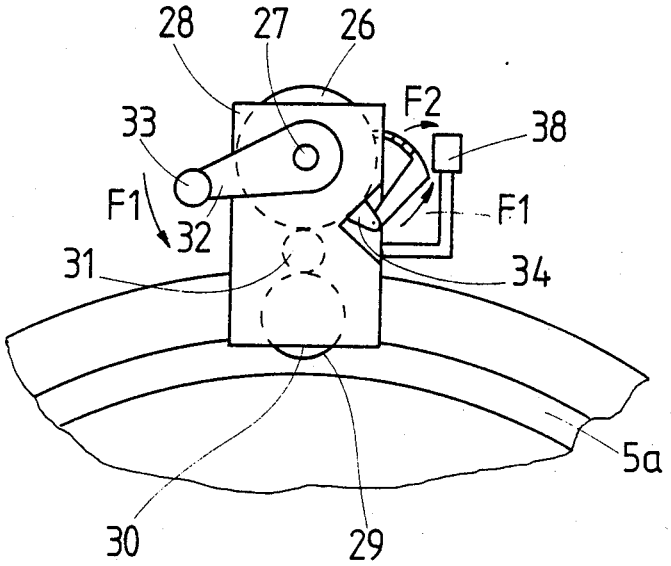

FIG. 6*a* shows a diagrammatic plan view on that numbering mechanism on an enlarged scale; and FIG. 6*b* shows a side view of this numbering mechanism.

DESCRIPTION OF THE PREFERRED EMBODIMENT

Figure 1A:
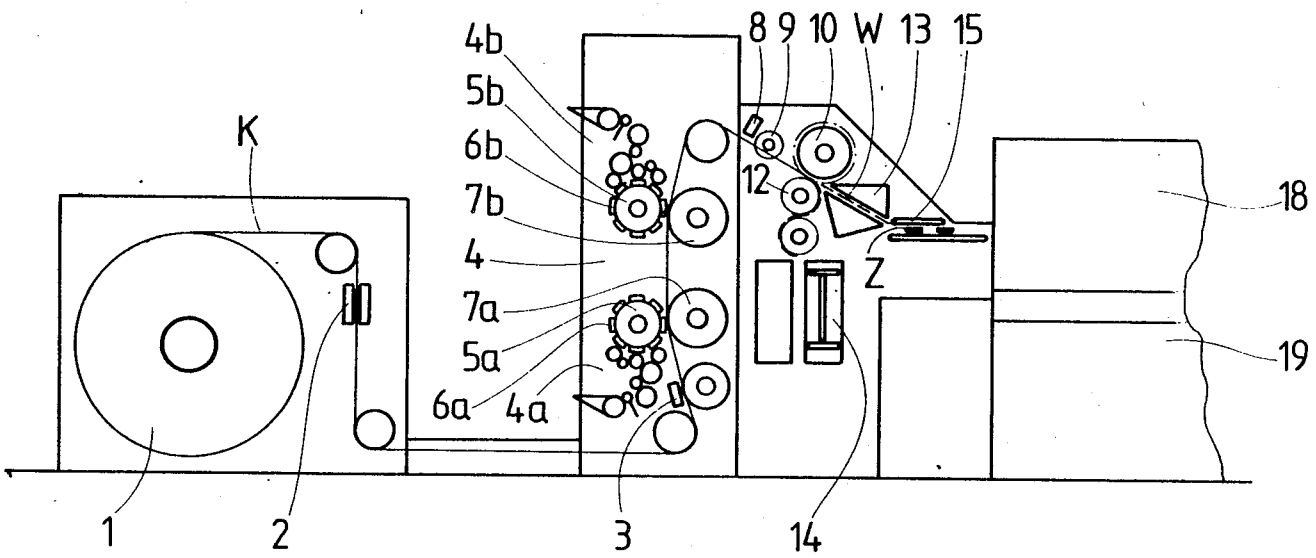
Figure 1B:
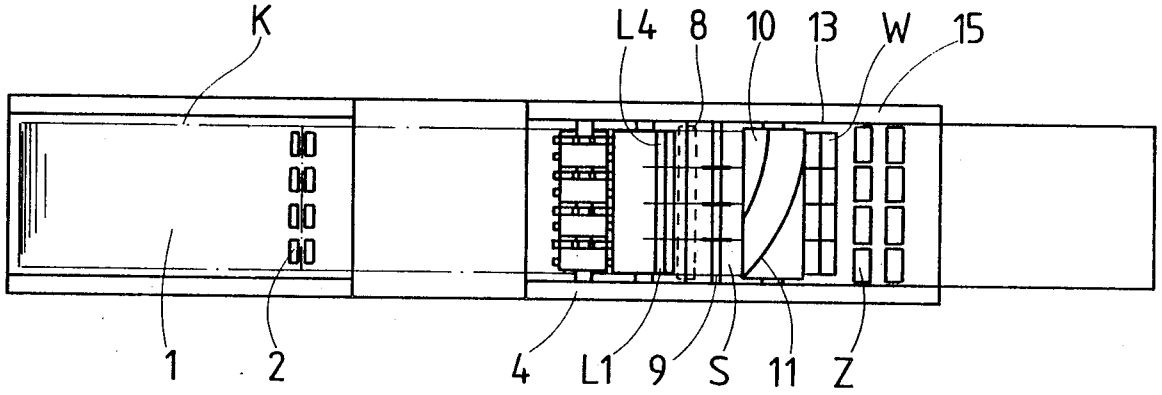

The process according to the invention, in the example under consideration according to FIGS. 1*a* and 1*b*, starts from a freshly printed security paper web K, printed on both sides, on which the still unnumbered security paper prints are arranged in four parallel longitudinal rows. These security paper prints are to be provided with numbers on one side. In FIG. 2 which shows the security paper web K with the security paper prints M numbered on this side in the form of rectangles, and in FIG. 1*b*, the longitudinal rows are denoted as L1, L2, L3 and L4. A visual quality check of all security paper prints has been made by an expert on both sides of the security paper web K in a customary manner and all spoilt notes Mx, which have to be separated out as rejects later on, have been provided with a mark which can be read by a detector. This mark is indicated diagrammatically in FIG. 2 by a cross.

The security paper web K, reeled off from a roll 1, first passes through a reading instrument 2 which possesses on each side of the security paper web K four reading heads each, associated with the longitudinal rows, the reading heads reading the marks on the spoilt notes Mx and feed their positions into a computer 20 (FIG. 3) where these spoilt note positions are stored. The security paper web K then passes into a cancellation printer 3 which is controlled by the computer 20 and prints all spoilt notes Mx, on the side of the security paper web to be numbered, with a cancellation print which is applied to the areas provided for the numbers and is indicated in FIG. 2 merely by the number represented by a broken line. The cancellation printer 3 is mounted preferably inside the numbering machine 4.

The security paper web K thus prepared passes through the numbering machine 4 which, in the example under consideration, comprises two numbering printers 4*a* and 4*b*, by means of which the security paper numbers are printed on in two different areas of each security paper, as in generally customary. These are essentially conventional numbering printers, each comprising a numbering cylinder 5*a* or 5*b*, carrying, in the example under consideration, eight groups of numbering mechanisms 6*a* or 6*b*, evenly distributed over its periphery, and each also comprising a counterpressure cylinder 7*a* or 7*b*. Each group of numbering mechanisms consists of four numbering mechanisms which are located in a row parallel to the cylinder axis and are associated with the four longitudinal rows, L1, L2, L3 and L4, of the security paper prints (FIG. 1*b*). Eight transverse rows of security paper prints, placed in succession in the direction of feed of the security paper web K, are therefore numbered at each complete revolution of the numbering cylinder 5*a* or 5*b* and this is done, as will be explained in detail later on, so that all satisfactory security paper prints, placed in succession in a longitudinal row, L1, L2, L3 or L4, receive serial numbering, spoilt notes Mx being excluded. In this connection, the security paper prints in each transverse row of the example under consideration receive the same numerical sign, but another numerical series, indicated in FIG. 2 by the capital letters A, B, C and D, is associated with each longitudinal row.

For carrying out this novel method of serial numbering of exclusively satisfactory security paper prints, the individual numbering mechanisms 6*a* and 6*b* can be operated independently of each other and are constructed so that they can be controlled individually by the computer 20. Whereas, hitherto, all numbering mechanisms mounted on a numbering cylinder of a numbering machine are positively moved forward by one number for each complete revolution of the numbering cylinder by means of a mechanical forward motion lever, operated from a stationary control bend at each revolution of the cylinder, numbering mechanism are provided for the process according to the invention, whose single digit number roll is moved forward by a small electric motor, associated with each numbering mechanism. This motor receives its electric control signals from the above-mentioned computer 20 in which the positions of the spoilt notes are stored.

The numbering mechanisms are thus not moved forward positively, as hitherto, at each revolution of the numbering cylinder by one unit, but with the aid of individually controllable motors. In order to move the double digit number roll and the higher digit number rolls forward, the known forward motion lever is used, which is however designed such that it acts only on the double digit and the higher digit number rolls and, while it is operated by the control bend at each revolution of the numbering cylinder, it is made inactive in its function by electric blocking signals of the computer 20, if the double digit number roll is not to be moved forward. An exemplary embodiment of this type of numbering mechanism will be explained in detail later on with reference to FIGS. 6, 6*a* and 6*b*. The double digit number roll and the higher digit number rolls are coupled in a known manner by the operating catches of the forward motion lever in such a way that the number roll for the next higher digit is moved forward when the number roll of the next lower digit switches from 9 to 0. Thus, when the double digit number roll is moved by the forward motion lever from 9 to 0, the treble digit number roll is carried along in a known manner by one number etc.

With the exception of the special control of the single digit number roll and the design and control of the forward motion lever, the construction of the numbering mechanisms is of a known type.

The numbering mechanisms 6*a*,6*b* are controlled by the computer 20 in such a way that,—as long as no spoilt note passes into the numbering machine,—the security paper prints, placed in succession within any longitudinal row, L1 to L4, are serially numbered. If, generally, a numbering cylinder contains N groups of numbering mechanisms, distributed over its periphery and each associated with a transverse row of security paper prints, each numbering mechanism 6*a* and 6*b* of a group of numbering mechanisms is moved forward by N steps at each revolution of the numbering cylinder. In the example under consideration, where N=8, forward movement always takes place by eight units, since each individual numbering mechanism numbers every ninth security paper print within the longitudinal row in question.

In this connection, the arrangement is such that each single digit number roll can be moved in either direction, so that switching from 1 to 9, for example, can take place in only two backward steps. In that case, at most five operating steps are generally required at movement reversal in one or the other direction, for setting any number desired.

If a spoil note Mx appears in a longitudinal row, all numbering mechanisms of the longitudinal row in question are controlled by the computer 20 in such a way that the numbering of the satisfactory security papers following on a spoilt note continues the correct numerical sequence of the satisfactory security notes numbered prior to the spoilt note. Thus each spoilt note is simply left out in the course of the serial numbering. The number applied to the spoilt note is without importance, since it is illegible owing to the cancellation overprint which has already been previously applied.

An example of a numbering operation shall be explained in detail in the following with reference to FIG. 2; for better understanding, the numbering mechanisms 6*a* and 6*b*, respectively, of the eight numbering mechanism groups of a numbering cylinder, which print the given numbers in the transverse rows, are denoted in the left-hand column of FIG. 2 by the Roman numerals I to VIII.

Preferably, the initial setting of the numbering mechanisms I to VIII for the numbering of the first eight security paper prints in any longitudinal row L1 to L4 already takes place automatically, as a function of the reading by the reading instrument 2. As long as the reading instrument 2 does not detect any spoilt note in a longitudinal row, the numbering mechanisms I,II,III, . . . VIII, which are associated with that longitudinal row and which number the security paper prints in the first to eight transverse rows, are set to the serial numerical sequence 1,2,3 etc., before the passage of the zone of the security paper web K, containing the security paper prints M, through the numbering machine 4 begins. As soon as a spoilt note is indicated, the cancellation printer 3 comes into operation during the passage of this spoilt note and the numbering mechanism which numbers the security paper print, following on the spoilt note, is set to the same number as that numbering mechanism which applies the number print to the spoilt note; the subsequent numbering mechanisms are again set to the serial numerical sequence.

According to FIG. 2, the fourth security paper print in the longitudinal row L1 is a cancelled spoilt note Mx, receiving the serial number 4 which, however, is not legible due to the overprint. The numbering mechanism V of the same longitudinal row L1 which numbers the fifth security paper print has been set to the same number 4 and the three following numbering mechanisms V,VI and VII then continue with the serial numbering.

There are amongst the first eight security paper prints of the longitudinal rows L2 and L4 two spoilt papers Mx each and one spoilt note amongst those of the longitudinal row L3. In all cases, the numbering of the satisfactory security paper prints, following on the spoilt note, was done with a number smaller by one unit, that is to say, with the same number as had been received by the spoilt note.

The numbering mechanism I of the longitudinal row L1, having printed the first number 1, is set during the subsequent revolution of the numbering cylinder not by eight steps, but, owing to the spoilt note Mx, which has appeared meanwhile, only by seven steps to number 8; similarly, the three subsequent numbering mechanisms II, III and IV, for bringing about a correct numerical sequence, are moved on by seven steps to numbers 9 to 11. Altogether, therefore, all the eight numbering mechanisms V to VIII and I to IV which belong to the longitudinal row L1 and which number the eight satisfactory security paper prints, following on the spoilt note (containing the number print 4), were set to a number which is smaller by one unit than in the absence of a spoilt note. Only the numbering mechanism V and the following ones are again moved forward by eight steps, provided that no further spoilt note appears. Since, in the example under consideration, a further spoilt note Mx appears in the longitudinal row L1 which has received the number 14, rendered illegible by the overprint, only the numbering mechanisms V.,VI and VII have been moved forward by eight steps, the numbering mechanism VIII however only by seven steps.

The spoilt notes in the longitudinal rows L2, L3 and L4 are distributed differently and, accordingly, the numbering mechanisms of these longitudinal rows are also moved forward differently. Since two spoilt notes appear in the fifth and seventh places amongst the first eight security paper prints in the longitudinal row L2, the numbering of the second group of eight security paper prints, which do not contain any spoilt note in the example under consideration, is effected by moving the numbering mechanism I to V forward only by six steps, the numbering mechanisms VI and VII by seven steps and the numbering mechanism VIII by eight steps. Forward movement in the longitudinal rows L3 and L4 is effected in analogous fashion.

Since the numbers applied to the spoilt notes are without importance and, besides, illegible, it would be possible, in principle, to apply any numbers whatever to the spoilt notes, therefore also, for example, the same number which the respective preceding satisfactory security paper print had received. It would also be possible to dispense with the forward movement of a numbering mechanism which numbers a spoilt note and to set directly that number which the next satisfactory security paper print to be numbered by this numbering mechanism is to receive. All that is important is that the satisfactory security paper print, following on a spoilt note, always receives the number directly following on the number of the preceding satisfactory security paper print.

The numbering method described is continued and illustrated in the example according to FIG. 2 up to the sixteenth transverse row and then again for the last three transverse rows of a numbering sequence, which is interrupted as soon as satisfactory security papers have been numbered in a longitudinal row up to a certain maximum number of the numerical series in question, up to 100,000 in the example under consideration.

The assumption in the example under consideration according to FIG. 2 is that the numerical series B in the longitudinal row L2 has been numbered as the first one up to the final number of the cycle in question, that is to say, up to B 100,000 whereas the three other numerical series, A,C and D, in the longitudinal rows L1, L3 and L4 have been numbered only up to numbers A 99,425, C 99,227 and D 99,731. It should be noted that the number of the still missing security paper print up to the respective final number 100,000 in the longitudinal rows L1, L3 and L4 bears no relation to the number of spoilt notes in the longitudinal row in question and is certainly not equal to the number of these spoil notes. In fact, the number of the numerals missing up to the final number 100,000 under consideration is equal to the number of spoilt notes in the longitudinal row which is ready-numbered already minus the number of spoilt notes in the longitudinal row under consideration, the numbering of which has not yet been finished. If, by chance, the same number of spoilt notes always exists in each longitudinal row within a given complete numerical series, the respective final number will evidently be reached simultaneously for all the four longitudinal rows with the same last transverse row. However, this case is extremely unlikely.

Thus if, after reaching the final number in one of the longitudinal rows, the numbering of the security papers in the other longitudinal rows has not yet reached the final number, because those longitudinal rows have larger numbers of spoilt notes, the numbering can be completed in two different ways.

Either: The numbering mechanism of the numbering machine can be controlled with the aid of the computer 20 in such a way that all numbering mechanisms of a longitudinal row are put out of operation automatically as soon as the final number 100,000 has been printed into the longitudinal row, while the security paper web K is moved further forward without interruption and all numbering mechanisms of the other longitudinal rows continue working in the manner described until such time as the respective final number 100,000 has been printed in each case. The numbering machine cuts out only at that point. The arrangement for putting a numbering mechanism individually out of operation is that this numbering mechanism is moved out of its operational printing position and is therefore lifted above the counterpressure cylinder when passing the latter. This measure requires the numbering mechanisms to be mounted on the numbering cylinder so as to be capable of being moved individually. In the case of the method described of fully automatic numbering in each longitudinal row up to the final number of the respective numerical series, unnumbered security paper prints are evidently produced in the longitudinal rows,—with the exception of the last completely numbered one,—and these prints are separated out later on, counted as a check and simply destroyed; if appropriate, they can also be numbered with the numbers of a special series in a separate operation.

Or: The procedure can be such that by using numbering mechanisms for single security papers, which mechanisms are associated with each of the still incompletely numbered longitudinal rows,—that is to say, to the longitudinal rows A,C and D in the example under consideration according to FIG. 1,—the numbering of the security paper prints in these longitudinal rows is continued until the final number 100,000 has been reached, the spoilt notes being left out, which can be carried out semi-automatically, in particular, or also manually, if desired.

After leaving the numbering machine 4, the security paper web K passes through a reading instrument 8 FIGS. 1*a* and 1*b*) which reads the marks or cancellation prints and is then cut up in a known strip-cutting machine 9, operating as a longitudinal cutter with circular blades, into strips S and, behind that, in a known bundle-cutting machine 10 into individual security papers W of the finished format, the so-called individual copy numbers. This bundle-cutting machine 10 is a transverse cutter, the blade 11 of which is indicated diagrammatically in FIG. 1*b*.

The individual security papers W pass in rows through a device 12, similarly known per se, for separating out the spoilt notes. This device 12 is controlled by the reading instrument 8 which, on detecting a spoilt note, emits an appropriately time-delayed separation signal for reversing the device 12. Evidently, the positions of the spoilt notes detected by the reading instrument 8 have to agree with the positions stored in the computer 20, allowance being made for the known transport speed, so that the results of the reading instrument 8 afford an additional check for spoilt notes.

The device 12 for separating out the spoilt notes, which interacts with the drum of the bundle-cutting machine 10 in the example under consideration, operates with suction rollers which allows the satisfactory security papers to pass without being deflected, when the suction action is turned off, so that these security papers can reach a conveyor system 13, while, when the suction action is turned on, the spoilt notes are carried along on the circumference of the suction rollers and passed towards a collection point 14. A separation device operating with suction rollers of this kind is described, for example, in the prior European patent application No. 80201063.7, corresponding to U.S. Pat. No. 4,299,325. Other automatically controllable separation devices for security papers are disclosed, for example, in West German patent specifications Nos. 1,499,514 and 1,524,627, corresponding to U.S. Pat. No. 3,412,993.

The separated spoilt notes are counted for checking purposes and the number is compared with the number of spoilt notes stored in the computer, before they are destroyed.

The transport sequence of the remaining satisfactory security papers now has a correct, complete numerical sequence within the respective numerical series. It is therefore sufficient to stack the security papers, placed in succession on the conveyor system 13 within each longitudinal row, in a manner that is known per se, in a bundle-forming station 15, to form security paper bundles Z of 100 security papers each, as indicated diagrammatically in FIG. 1*a*. The security paper bundles Z are then passed towards a buffer station 18 and, finally, towards a packaging station 19 where the security paper bundles Z are given revenue seals, a certain number of security paper bundles, generally ten bundles, are always stacked to form security paper parcels and these security paper parcels, after repeated counting of the security papers, are given revenue seals and packaged to form parcels. It is ensured, in this case, that each parcel contains a predetermined number of security papers, having a complete numerical sequence within a given numerical series. The buffer station 18 enables a larger number of security paper bundles to be stored, before reaching the revenue-sealing and packaging station 19. In this way, the normal speed of the preceding numbering, cutting and separating operations can be maintained even if the operation of station 19 has to be interrupted or can proceed only with delay for a certain time for any reason.

In principle, numbering mechanisms can also be used for numbering the security paper prints in which all number rolls can be controlled electrically, independently of one another. In that event, the double digit number rolls and the higher digit number rolls are also controlled individually by the computer 20. In that case, the number rolls can be designed such that, apart from the ten numerals, they have a non-printing space or a cancellation sign; they can then be set in the presence of a spoilt note so that no printing takes place at all or, alternatively, the cancellation marks are printed on. This measure can be applied evidently also to those security paper prints of a longitudinal row which, as has been described before, still pass through the numbering machine, following complete numbering of this longitudinal row, until the security paper prints in all thee other longitudinal rows have also been numbered completely up to the final number. When using the numbering mechanisms described above, the number rolls of which have cancellation signs, the special cancellation printer 3 may be dispensed with.

On the other hand, it is also feasible,in principle, to prevent a spoil note being numbered by moving the respective numbering mechanism temporarily out of its working position, while passing by that spoilt note, that is to say, shfting it radially somewhat into the interior of the numbering cylinder, so that the spoilt note runs through the respective numbering printer without coming into contact with the numbering mechanism. For this purpose, all numbering mechanisms of any numbering cylinder have to be mounted so that they can be moved individually out of their working position. This movement could then be brought about mechanically, with the aid of an eccentric tool, or, alternatively, electromagnetically, the respective control signals for adjusting the position of the numbering mechanism being given by the computer 20.

The process according to the invention will be explained for the case of security paper sheets, producedd by sheet-printing, with reference to FIGS. 4 and 5. In this case, those processing stations which correspond to the stations in the example according to FIG. 1*a*, are denoted by identical reference signs in FIG. 4. In FIG. 5, illustrating a modification of the processing method according to FIG. 4, these reference signs denote only the processing points in question.

The security paper sheets F, provided with security paper prints, but yet unnumbered, are first checked for defective security paper prints, the spoilt notes being marked. These marked spoilt notes are denoted by a cross in FIG. 5.

Figures 3, 4:
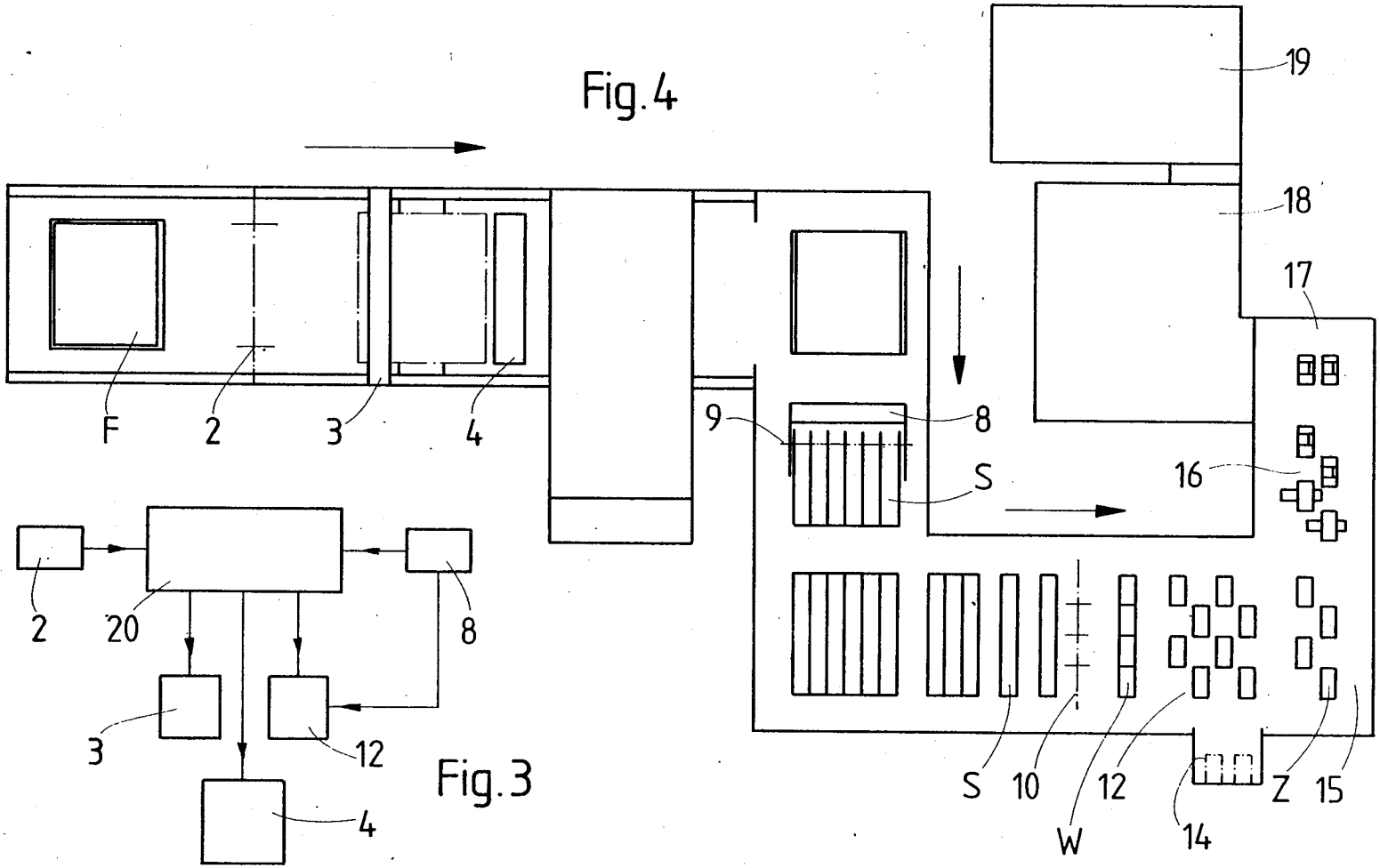
FIG. 3 shows the block diagram for controlling the apparatus according to FIG. 1 by a computer.
FIG. 4 shows in diagrammatic representation, an apparatus for carrying out the process in the case of security paper sheets.
Figure 5:
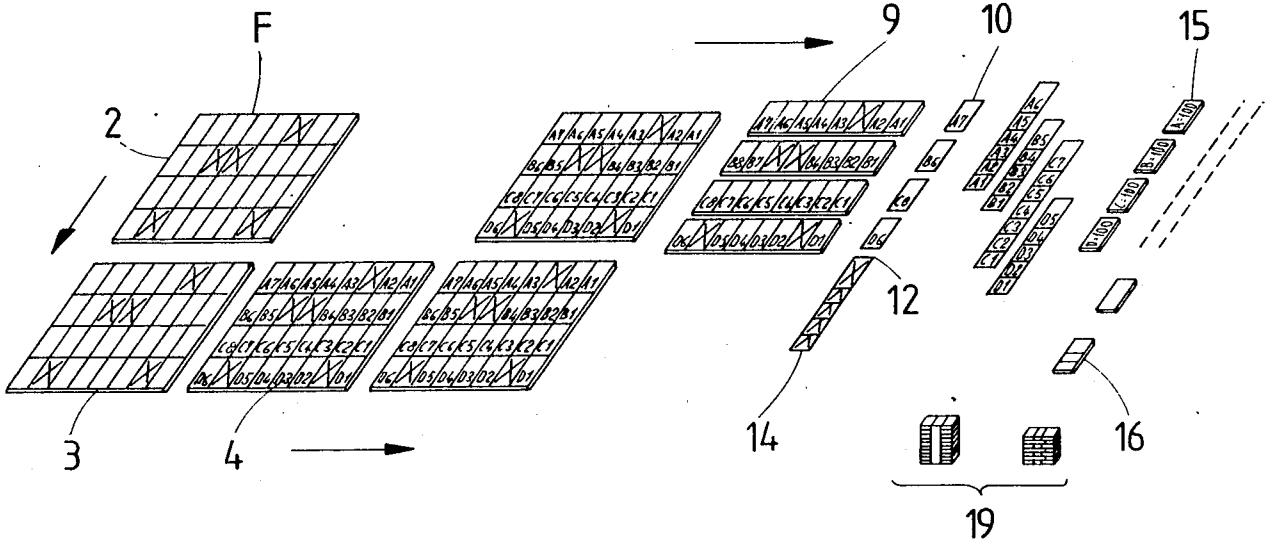
FIG. 5 shows diagrammatically a numbered security paper sheet in course of being processed.

The sheets thus checked then pass through the apparatus in the direction of the arrows indicated in FIGS. 4 and 5 and pass, individually in succession, first a reading instrument 2, a cancellation printer 3 and a numbering machine 4, which may have the same construction as in the example according to FIG. 1*a*. The positions of the marked spoilt notes are read by the reading instrument 2 and stored in a computer controlling the cancellation printer 3 for cancelling the spoilt notes and the numbering machine 4 in the manner already described for the case of a security paper web. Each sheet F in the example under consideration comprises 4 times 8 security paper prints which, relative to the direction of passage through the numbering machine 4, are arranged in four longitudinal rows and eight transverse rows. Accordingly, each numbering cylinder of the numbering machine has eight groups of numbering mechanisms, evenly distributed over its curcumference, which number a sheet at each revolution of the numbering cylinder and each group of which has four parallel numbering mechanisms for the simultaneous numbering of a transverse row. The security paper prints in each longitudinal row of a sheet each belong to a numerical series A,B,C or D (FIG. 5) and are being serially numbered, but to the exclusion of spoilt notes. In the example according to FIG. 5, the sheet contains a spoilt note in the longitudinal row comprising the numerical series A and two spoilt notes each in the longitudinal rows comprising the numerical series B and D. The numerical sequence is continued in each longitudinal row on the following sheet.

No sheet stacks are being formed at the exit of the numbering machine 4, as is customary in conventional processing, but the sheets are processed further individually in succession.The sheets pass by a reading instrument 8 which reads the cancellation prints and are cut into strips S in a strip-cutting machine 9 which, again, is a longitudinal cutter. The strips S are cut up into individual security papers W in a bundle-cutting machine 10. In the example according to FIG. 4, this bundle-cutting machine 10 is similarly a longitudinal cutter, whereas, in the example according to FIG. 5, a transverse cutter is used for bundle cutting.

The spoilt notes are separated out in a separation device 12 which can be controlled by the reading instrument 8 or the computer in the same way as described in the first exemplary embodiment according to FIGS. 1*a* and 1*b* and passed towards a collection station 14. The satisfactory individual security papers W, always originating from the same longitudinal row, are then assembled in a bundling station 15 to form security paper bundles Z of 100 security papers each, having a complete numerical sequence. These security paper bundles Z are revenue-sealed at a revenue sealing station 16 and passed via a transport track 17 towards a buffer station 18 and then towards an automatic packaging station 19, where always ten security paper bundles are stacked to form security paper parcels, comprising the serially numbered security papers belonging to the same numerical series, are revenue-sealed and packaged.

FIG. 6 shows diagrammatically the fitting of one of the numbering mechanisms 6*a* to the numbering cylinder 5*a* which is fastened to the shaft 4' of the numbering printer 4*a* of the numbering machine 4. The numbering mechanism 6*a* in the example under consideration according to FIG. 6*a* comprises six number rolls 21 to 26, that is to say, a single digit number roll 21, a double digit number roll 22, a treble digit number roll 23 etc. All number rolls 21 to 26 are fitted in the numbering mechanism frame 28 so as to be rotatable about a common axis 27. The single digit number roll 21 is kinematically independent of the other number rolls 22 to 26 and is moved forward by a small electric motor 29 (FIGS. 6 and 6*b*), controlled by the computer 20 in the manner described, a gear-wheel 30, located on a motor shaft, gearing with an intermediate gear-wheel 31, which engages in a corresponding indentation of the signal digit number roll 21.

A two-armed forward motion lever 32 (FIGS. 6*a* and 6*b*) which is known per se is provided for the forward movement of the remaining number rolls 22 to 26; this lever is rotatable about the axis 27 and carries, at one end, an actuating roll 33 and, at the other end, a catch carrier 34 with operating catches 35 moulded on, the so-called fore-catchers. This catch carrier 34, comprising the operating catches 35, is supported rotatably about an axis 36 on the respective arm of the forward motion lever 32 and prestressed by a spring (not shown) in such a way that the operating catches 35 are pressed in the direction of the indentations fixed at the side of the number rolls 22 to 26. The depth of the tooth gaps of the various indentations of the number rolls 22 to 26 and the lengths of the associated operating catches 35 are designed and dimensioned in a known manner in such a way that the operating catch 35, associated with the double digit number roll 22, always engages in the indentation of that number roll, but that the operating catch 35, associated with the treble digit number roll 23, can engage in the indentation of the catch only if the double digit number roll 22 is set to number 9. In analogous fashion, the other operating catches 35 for the number rolls 24 to 26 of the next higher places are always out of gear with the respective indentations if the number roll of the next lower place is not set to number 9, but is in gear with the respective indentation of that number roll of the next lower place is set to number 9. In case that all number rolls 22 to 26 are set to number 9, and only then, all five operating catches 35 are in gear with the respective indentations.

At each revolution of the numbering cylinder 5*a*, the actuating roll 33 of the forward motion lever 32 runs on to a control bend 37, firmly fixed to the numbering printer 4*a*, as a result of which the forward motion lever 32 is pivoted temporarily in the direction of the arrow F1 according to FIG. 6*b*, and, in this way, the double digit number roll 22 and, if appropriate, thoses additional number rolls are moved forward by one step, for which the associated operating catches 35 are in gear with the respective indentations. However, in order to avoid forward movement of the double digit number roll 22, while the forward motion lever 32 is actuated by the control bend 37, in those cases when the double digit place of the number to be printed is not to be altered, an electromagnet 38 is firmly fitted to the numbering mechanism frame 28 or to the numbering cylinder within the zone of the catch carrier 34 and this electromagnet, when energized, turns the catch carrier 34 with its operating catches 35 against the action of the above-mentioned spring in the direction of the arrow F2 according to FIG. 6*b* about the axis 36 and, in this way, lifts off all operating catches 35 from the indentations of the number rolls. While the forward motion lever 32 positively performs its forward motion stroke in this way, on running on to the control bend 37, the double digit number roll 22 and the other number rolls for the next higher places respectively, are not moved forward, as a result of the operating catch 35 being lifted off. If the electromagnet 38 is not energized, however, the double digit number roll 22 is moved forward by one step when the forward motion lever 32 is actuated; if the double digit number roll is moved, at that stage, from number 9 to number zero, the treble digit number roll 23 is carried along by the adjacent operating catch 35 by one step at the same time etc.

The apparatus according to the invention is not limited to the exemplary embodiments described but permits many kinds of variation, particularly regarding the structural design of the individual stations and, above all, of the numbering mechanisms and their control.

What is claimed is:

1. Process for processing print carriers, printed with security paper prints, in the form of security paper webs or security paper sheets, the security paper prints of which are arranged in the manner of matrices in transverse rows and longitudinal rows, comprising the steps of a. marking spoilt prints detected on said print carriers;

b. scanning the positions of all spoilt prints on the printed carriers and storing these positions before the print carriers are numbered;

c. feeding said print carriers in a numbering machine, where only the satisfactory security paper prints are serially numbered on the print carriers, while said serial numbering is interrupted when a spoilt print appears, and continued when the next satisfactory security paper print appears, the numbering mechanism of said numbering machine being controlled individually as a function of said stored positions;

d. applying cancellation prints to said spoilt prints, said operation being controlled as a function of said stored positions and being effected before cutting up said print carriers;

e. cutting up said print carriers to individual security papers cut to size;

f. eliminating the individual security papers having spoilt prints;

g. assembling the remaining serially numbered individual security papers to form bundles with complete numerical sequence in each case.

2. Process according to claim 1, wherein the cancellation print is applied in the printing zone of the number.

3. Process according to claim 1, in which, for numbering the security paper prints in any longitudinal row, extending in the direction of feed of the print carriers, N numbering mechanisms are used which are distributed over the periphery of the numbering cylinder of a numbering machine and can be shifted during each revolution of the numbering cylinder, wherein only the satisfactory security paper prints, placed in succession within any longitudinal row, are serially numbered and, for this purpose, the N numbering mechanisms, associated with a longitudinal row, are set on serial numbers, as long as no spoilt print appears, and are always shifted forward by N numbers on each revolution of the numbering cylinder, but, in the presence of a spoilt print, are shifted in such a way that the numbering of the satisfactory security paper prints, following on a spoilt print, continues the correct numerical sequence of the satisfactory security paper prints which had been numbered before the spoilt print, and that the numbering in any longitudinal row is completed individually when the last number of the numerical series in question, associated with that longitudinal row, has been printed.

4. Process according to claim 3, wherein, after the numbering of the security paper prints in at least one longitudinal row has been completed, the numbering machine continues working in such a way that the security paper prints in all other longitudinal rows are serially numbered until the respective last number of the numerical series in question has been printed and each numbering mechanism is stopped individually after the printing of this last number and, after the print carriers have been cut up into individual security papers, the unnumbered security papers are separated out, having passed by the numbering machine after the respective numbering mechanism had been stopped.

5. Process according to claim 3, wherein the simultaneous serial numbering of the security paper prints of all longitudinal rows is interrupted when the last number of the numerical series in question has been printed in at least one of the longitudinal rows, and the numbering of the security paper prints in the remaining longitudinal rows is completed subsequently up to the last respective number by means of auxiliary numbering mechanisms.

6. Process according to claim 1, wherein the printing of a number on to a spoilt print is prevented by moving the respective numbering mechanism of the numbering machine temporarily out of its working position, while that spoilt print is passing by, or by setting the number rolls of the numbering mechanism to a cancellation mark or to a non-printing space.

7. Apparatus for processing print carriers, printed with security paper prints, in the form of security paper webs or security paper sheets, wherein spoilt prints on said print carriers have been marked and are detected, said security paper prints on said print carriers being arranged in the manner of matrices in transverse rows and longitudinal rows, comprising a. numbering machine;

b. at least on reading instrument for reading the marked spoilt prints, said reading instrument being situated in the direction of transport of the print carriers in front of said numbering machine and designed for ascertaining the positions of the spoilt prints;

c. a computer in which the positions of spoilt prints ascertained by said reading instrument can be stored and by which said numbering machine is controlled in such a way that only satisfactory security paper prints are serially numbered, the spoilt prints being excluded;

d. cutting machines for cutting up the print carriers to individual security papers;

e. a cancellation printer for the spoilt prints, controlled by said computer, installed in front of the cutting machines;

f. a separation device mounted behind the cutting machines and being controlled by the computer or an additional reading instrument and designed for separating out from the transport sequence the individual security papers which have been marked as spoilt notes; and g. a station for forming and packaging security paper parcels.

8. Apparatus according to claim 7 wherein said numbering machine includes a numbering cylinder, numbering mechanisms and a forward motion lever, operated during each revolution of said numbering cylinder and operating catches that engage indentations of number rolls belonging to said numbering mechanisms to permit forward motion of said number rolls, wherein the numbering mechanisms have a units' digit number roll which is kinematically independent of the forward motion lever and of the adjacent tens digit number roll, the units' digit number roll being electrically operable by control signals, preferably in either direction, wherein the forward motion lever acts only on the tens digit number roll and the higher digit number rolls, and wherein the operability of said forward motion lever can be made inactive by an electric blocking signal of the computer, particularly by electromagnetic removal of its operating catches from the indentations of the number rolls, the tens digit number roll being coupled or capable of being coupled kinematically with the remaining, higher digit number rolls in a customary manner in such a way, particularly by means of the operating catches of the forward motion lever interacting with the identations of the number rolls, that when a number roll is moved forward from number 9 to number 0, the number roll, associated with the next higher digit number, is carried along.

9. Apparatus according to claim 7, wherein all number rolls of any numbering mechanism of the numbering machine can be operated, independently of one another, by electrical signals.

* * * * *